US005800195A

United States Patent [19]

Endo et al.

[11] Patent Number: 5,800,195

[45] Date of Patent: Sep. 1, 1998

[54] DEWING-TROUBLE-PREVENTED WATER-PROOF CONNECTOR

[75] Inventors: Takayoshi Endo; Kazuhisa Ishizaki; Satoshi Yamada; Mitsuhiro Matsumoto, all of Shizuoka, Japan

[73] Assignee: Yazaki Corporation, Tokyo, Japan

[21] Appl. No.: 653,477

[22] Filed: May 24, 1996

[30] Foreign Application Priority Data

May 25, 1995 [JP] Japan ..... 7-126750

[51] Int. Cl.[6] ..... H01R 13/52

[52] U.S. Cl. ..... 439/271

[58] Field of Search ..... 439/271–277, 439/607–610, 108

[56] References Cited

U.S. PATENT DOCUMENTS

| | | | |
|---|---|---|---|
| 4,932,875 | 6/1990 | Ogawa et al. | 439/271 |
| 5,114,359 | 5/1992 | Chishima et al. | 439/271 |
| 5,222,909 | 6/1993 | Nomura et al. | 439/271 |

*Primary Examiner*—Hien Vu

*Attorney, Agent, or Firm*—Sughrue, Mion, Zinn, Macpeak & Seas, PLLC

[57] ABSTRACT

In a dewing-trouble-prevented water-proof connector assembly, its male connector is engaged with its female connector in such a manner that the front end portion of the inner housing of the male connector is engaged with the front end portion of the inner housing of the female connector in such a manner that the inner cylindrical surface of the front end portion of the male connector covers the outer cylindrical surface of the front end portion of the female connector, and the front end portion of the outer housing of the male connector is engaged with the front end portion of the outer housing of the female connector in such a manner that the front end portion of the outer housing of the male connector covers the front end portion of the outer housing of the female connector. In the connector assembly, an inner packing which is set in close contact with the inner cylindrical surface of the front end portion of the inner housing of the male connector is mounted on the outer cylindrical surface of the inner housing of the female connector, while an outer packing which is set in close contact with the inner cylindrical surface of the outer housing of the male connector is mounted on the outer cylindrical surface of the outer housing of the female connector.

5 Claims, 9 Drawing Sheets

DEWING-TROUBLE-PREVENTED WATER-PROOF CONNECTOR

BACKGROUND OF THE INVENTION

1. Field of the Invention

This invention relates to a connector assembly including inner housings in which terminals are accommodated, and electrically conductive covers which cover the inner housings; and more particularly to a dewing-trouble-prevented water-proof connector assembly in which the terminals and the electrically conductive covers are improved in water-proof effect.

2. Background

There is available a shielded connector (hereinafter referred to merely as "a connector", when applicable) in which its, internal conductor is covered with an electrically conductive cover (hereinafter referred to as "a metal shell", when applicable), thereby to shield the internal conductor from the outside electric field. An example of the connector of this type in which a metal shell is provided between an inner housing and an outer housing will be described with reference to FIGS. 12 through 14. FIG. 12 is a sectional view of a conventional male connector; FIG. 13 is a sectional view of a conventional female connector; FIG. 14 is a sectional view showing the engagement of those conventional connectors.

As shown in FIG. 14, the connector assembly includes a male connector 1 and a female connector 3 which is engaged with the male connector 1. Those connectors 1 and 3 are fundamentally equal in structure. For instance, in the case of the male connector, a cylindrical inner housing 7 is formed inside a cylindrical outer housing 5 of insulating resin material in such a manner that those housings 5 and 7 are integral with each other, or provided as one unit, and a shell inserting groove 11 are formed between the housings 5 and 7 into which a metal shell 9 is inserted.

On the other hand, a male terminal 17 is press-fitted on the conductor of the insulated core 15 of a shielded wire. The rear end portion of the aforementioned metal shell 9 is press-connected to a shielding braid 19 which covers the insulated core 15. The male terminal 17 connected to the shielded wire 13 is inserted into a terminal accommodating chamber 21 from behind which is formed in the inner housing 7. In this operation, the metal shell 9 connected to the shielding braid 19 is inserted into the shell-inserting groove 11. An annular rubber plug 23 is mounted on the shielded wire 13. The rubber plug 23 is fitted in the outer housing 5 in such a manner such that it is in close contact with the rear end portion of the outer housing 5. Behind the rubber plug 23 fitted in the outer housing 5, a rear holder 25 is provided. More specifically, the rear holder 25 is also fitted in the rear end portion of the outer housing 5 to prevent the rubber plug 23 from coming off.

The male connector 1 thus formed is engaged with the female connector 3 which is substantially equal in structure to the male connector 1. That is, when the male connector 1 is engaged with the female connector 3, the male terminal 17 is inserted into the female terminal 27, while the end portion 5*a* of the outer housing 5 of the male connector 1 is inserted into the end portion 29*a* of the outer housing 29 of the female connector 3. In this operation, the metal shell 9 at the end of the male connector 1 is engaged with the metal shell 31 at the end of the female connector 3; that is, the former 9 and the latter 31 are connected to each other. An outer packing 33 is mounted on the outer housing 29 of the female connector 3. The outer packing 33 is brought into close contact with the inner cylindrical surface of the outer housing 5 of the male connector 1, to prevent the entrance of water into the housings 5 and 29 from outside. Hence, the inside of the connector assembly is sealingly isolated from the outside by the outer packing 33, and the rubber plugs 23 and 35, mounted on the shielded wires 13 of the male and female connectors.

In the above-described connector assembly, the outer packing 33 is provided in the female connector, and the rubber plugs 23 and 35 are mounted on the shielded wires of the male connector and the female connector, so that the insides of the outer housings 5 and 29; that is, the shell inserting grooves 11 and 37, and the inner housings 7 and 39, are sealingly isolated from the outside.

The connector assembly thus constructed suffers from the following difficulty: That is, when, because of the difference in temperature between the inside and the outside of the connector assembly thus sealed, the temperature of the air in the connector assembly reaches a dewing temperature, then the inside of the connector assembly is wetted with dew. On the other hand, no insulating device is provided for the male terminal 17, the female terminal 27, and the metal shells 9 and 31. Hence, once the inside of the connector assembly is wetted with dew, then dew-drops flowing down paths 39*a*, 39*b* and 39*c* indicated by the heavy lines in FIG. 14, may result in the occurrence of electric leakage in the connector assembly.

SUMMARY OF THE INVENTION

In view of the foregoing, an object of the invention is to provide a dewing-trouble-prevented water-proof connector assembly sealingly isolated from the outside in which, even when its inside is wetted with dew, no electric leakage occurs between the terminals and the metal shells by the dew-drops formed inside the connector assembly, with the reliability in safety being markedly improved.

The foregoing object of the invention has been achieved by the provision of a dewing-trouble-prevented water-proof connector assembly including a male connector and a female connector in which inner housings covered with metal shells are provided inside outer housings of the male connector and female connector, respectively, terminals connected to the insulated cores of shielded wires are set in the inner housings, respectively, and the male connector is engaged with the female connector in such a manner that the front end portion of the inner housing of the male connector is engaged with the front end portion of the inner housing of the female connector in such a manner that the inner cylindrical surface of the front end portion of the male connector covers the outer cylindrical surface of front end portion of the female connector, and the front end portion of the outer housing of the male connector is engaged with the front end portion of the outer housing of the female connector in such a manner that the front end portion of the outer housing of the male connector covers the front end portion of the outer housing of the female connector, in which, according to the invention, an inner packing which is set in close contact with the inner cylindrical surface of the front end portion of the inner housing of the male connector is mounted on the outer cylindrical surface of the inner housing of the female connector, while an outer packing which is set in close contact with the inner cylindrical surface of the outer housing of the male connector, is mounted on the outer cylindrical surface of the outer housing of the female connector.

It is preferable that, in the connector assembly, inner rubber plugs are mounted on the insulated cores of the male connector and the female connectors, respectively, in such a manner that the inner rubber plugs close the gaps water tight which are formed between the insulated core of the male connector and the inner housing thereof and between the inner housing of the female connector and the insulated core thereof.

In addition, it is preferable that outer rubber plugs are mounted on the outer cylindrical surfaces of the outer covers of the shielded wires of the male connector and the female connectors, respectively, in such a manner that the outer rubber plugs close the gaps water-tight which are formed between the outer housing of the male connector and the outer cover of the shielded wire thereof and between the outer housing of the female connector and the outer cover of the shielded wire thereof.

Upon engagement of the male connector with the female connector, the front end portion of the inner housing of the male connector is brought into close contact with the inner packing, while the front end portion of the outer housing of the male connector is brought into close contact with the outer packing, so that the inner housings of the male connector and the female connector are engaged water-tight with each other while the outer housings of those connectors are engaged water-tight with each other.

The gap between the rear end portion of the inner housing of the male connector and the insulated core of the shielded wire thereof is closed water-tight by the inner rubber plug, and similarly the gap between the rear end portion of the inner housing of the female connector and the insulated core of the shielded wire thereof is closed water-tight by the inner rubber plug.

Accordingly, the inside of the connector assembly is divided into the spaces inside the inner housings, and the outer housing; that is, the connector assembly is sealed double. Thus, the metal shells inserted between the outer housings and the inner housings are insulated from the terminal accommodated in the inner housings, respectively. Hence, even when dew-drops are formed in one of the spaces, the difficulty is eliminated that the dew-drops flow in both of the spaces.

DETAILED DESCRIPTION OF THE PREFERRED EMBODIMENTS

Preferred embodiments of the invention will be described with reference to the accompanying drawings in detail.

Figure 1:
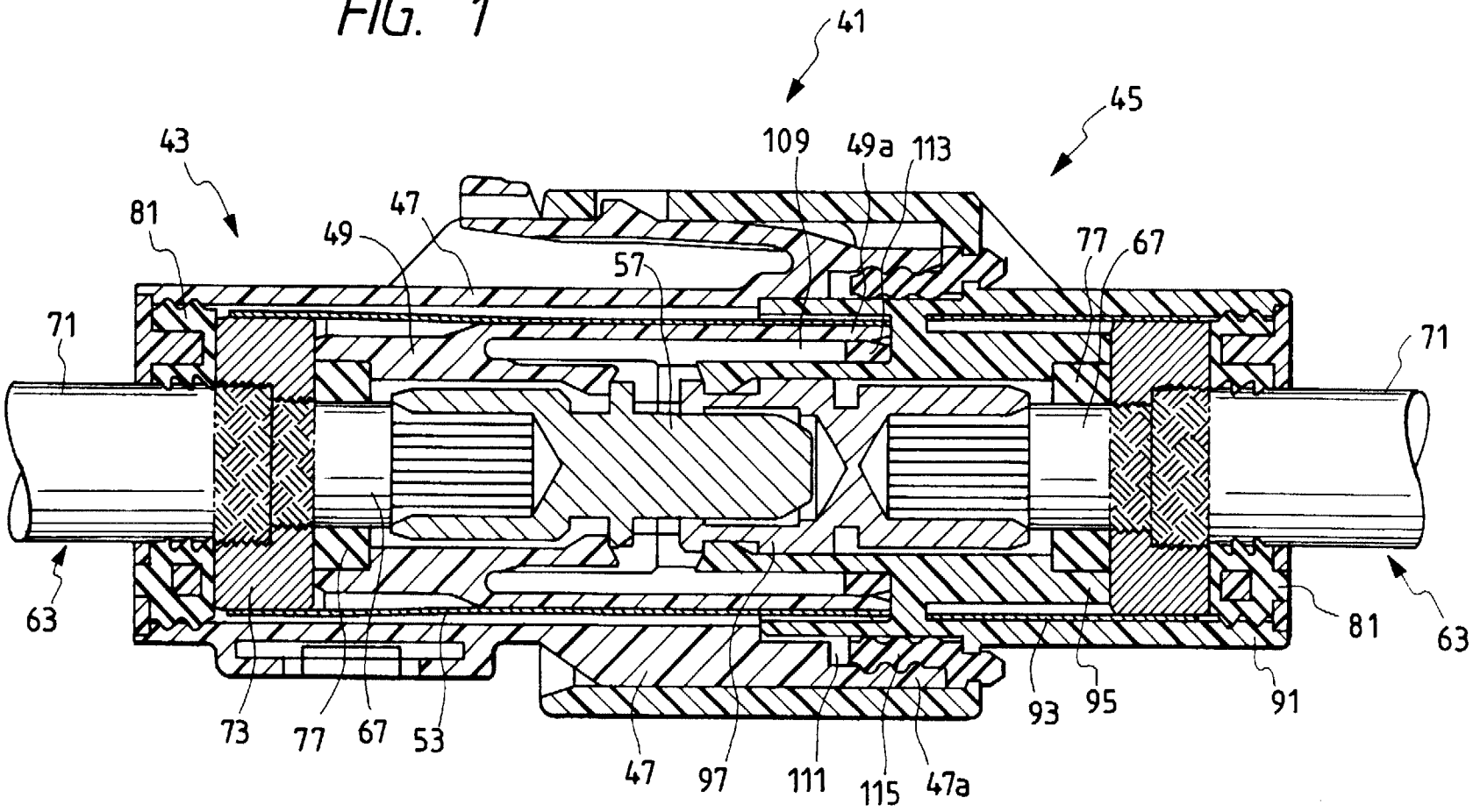
FIG. 1 is a sectional view showing an example of a dewing-trouble-prevented water-proof connector assembly, which shows a first embodiment of the invention.
Figure 2:
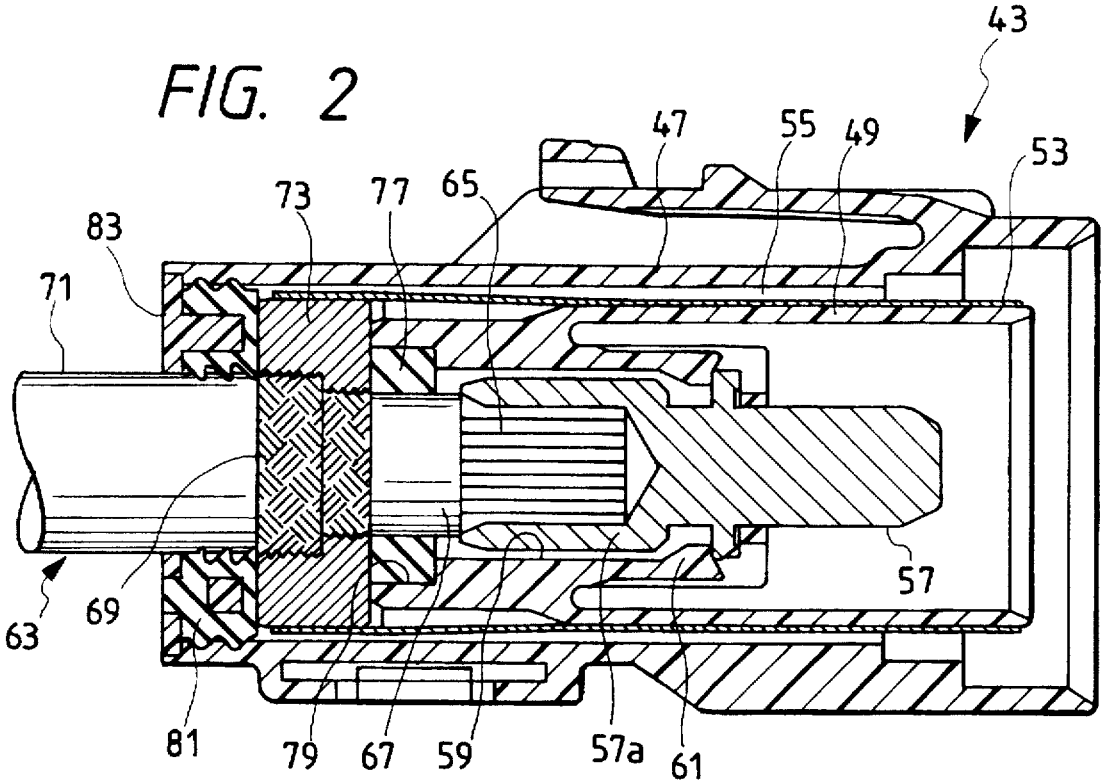
FIGS. 2 and 3 are a sectional view and a front view of a male connector forming the connector assembly shown in FIG. 1, respectively.
Figure 3:
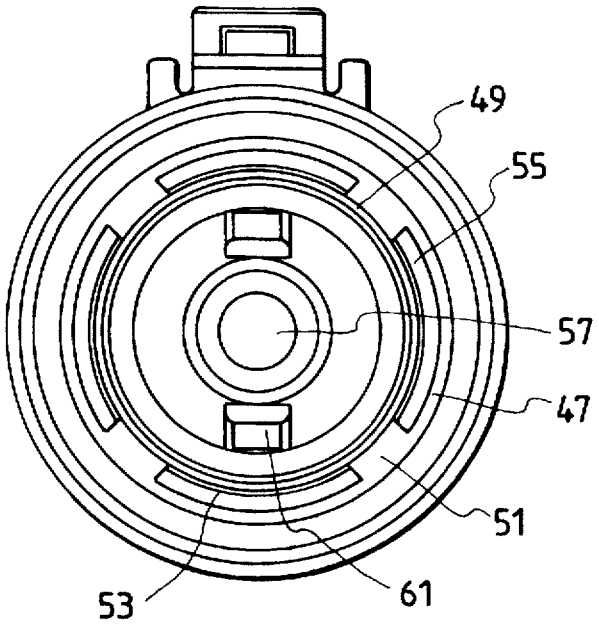
Figure 4:
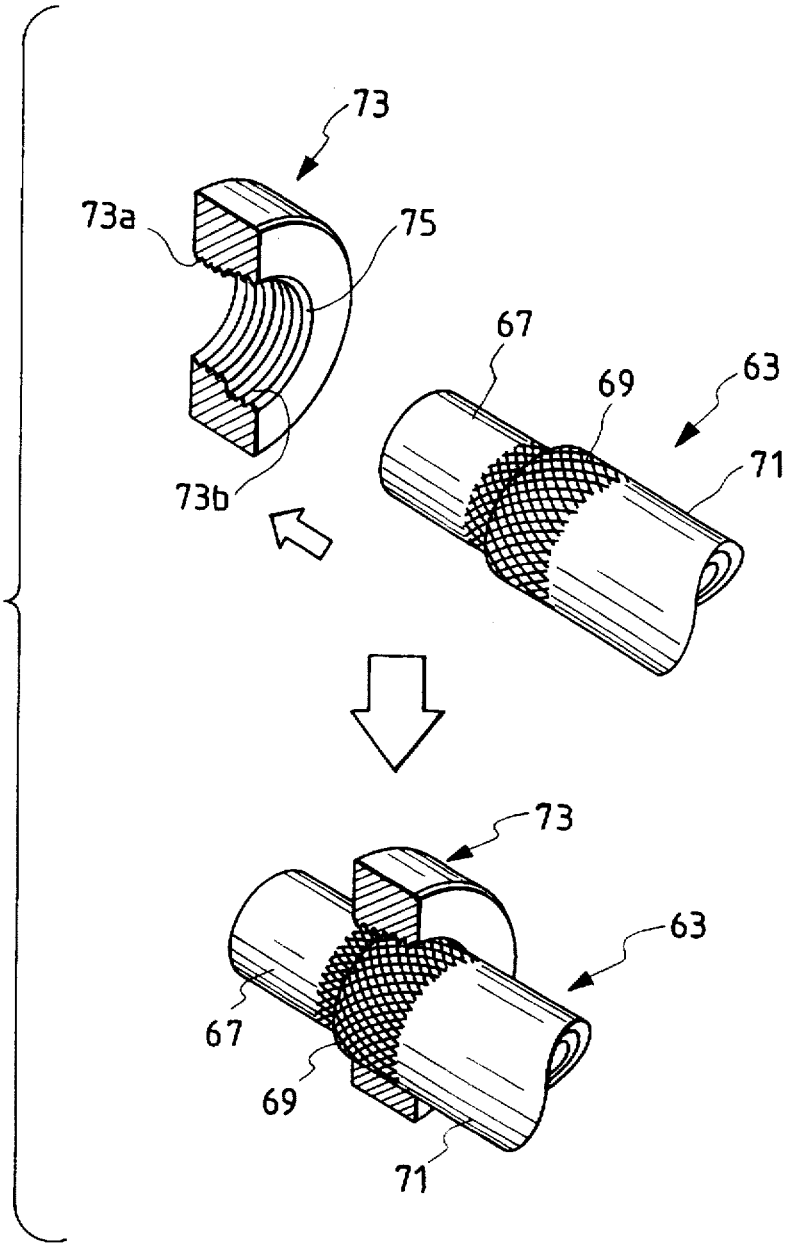
FIG. 4 is a perspective view for a description of the structure of the end portion of a shielded wire, and a contactor engaged with the end portion.
Figure 5:
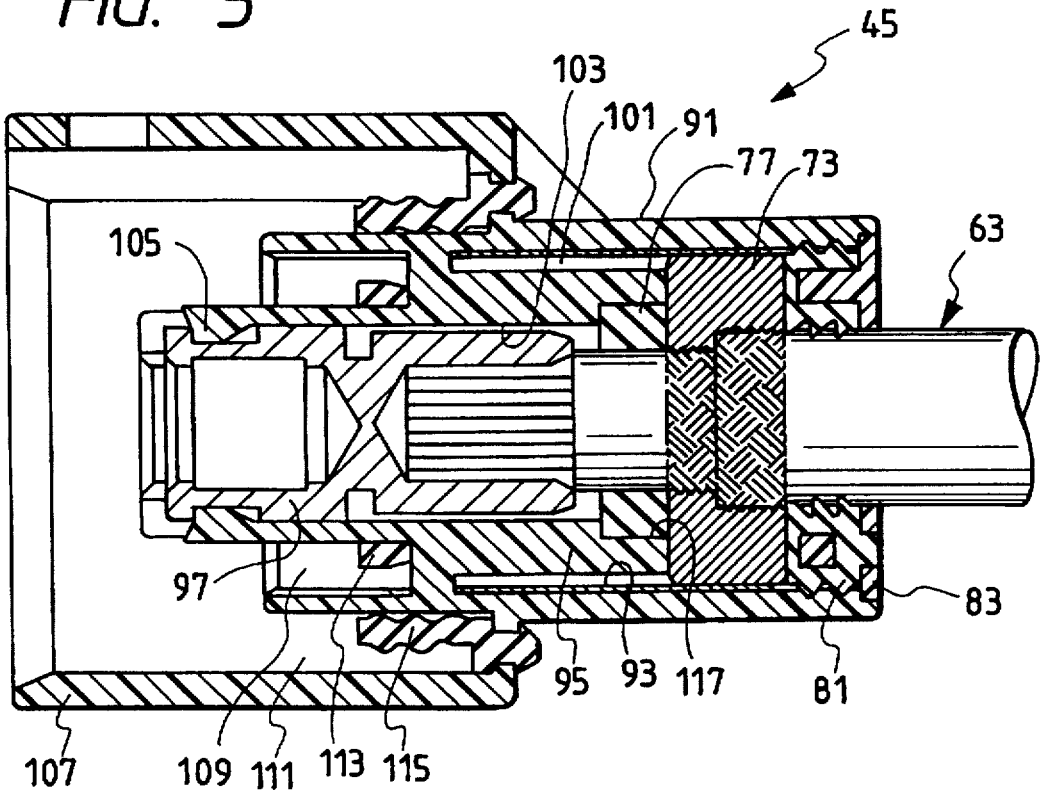
FIGS. 5 and 6 are a sectional view and a front view of a female connector forming the connector assembly shown in FIG. 1, respectively.
Figure 6:
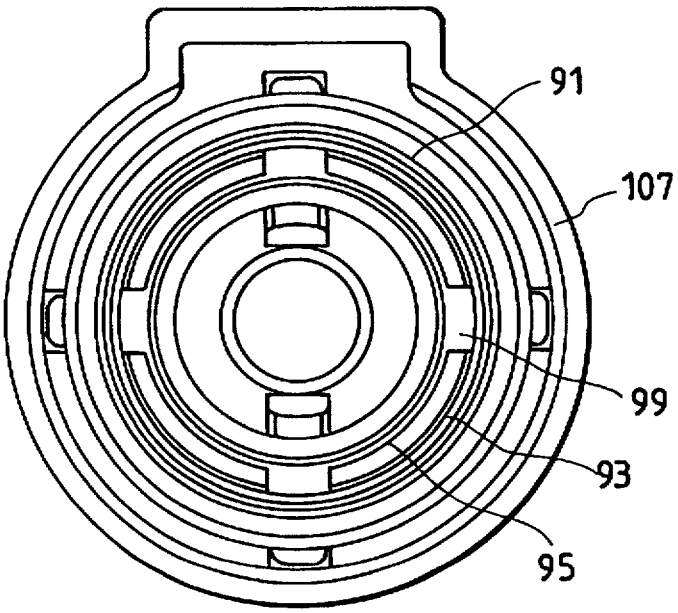

FIG. 1 is a sectional view showing an example of a dewing-problem-prevented water-proof connector assembly, which shows a first embodiment of the invention. FIGS. 2 and 3 are a sectional view and a front view, respectively, showing a male connector forming the connector assembly. FIG. 4 is a perspective view for a description of the structure of the end portion of a shielded wire. FIGS. 5 and 6 are a sectional view and a front view, respectively, showing a female connector forming the connector assembly.

The dewing-trouble-prevented water-proof connector assembly 41 (hereinafter referred to merely as "a connector assembly 41", when applicable) includes a male connector 43, and a female connector 45 which are engaged with each other. Those connectors are fundamentally similar in structure to each other.

First, the male connector 43 will be described. Inside a cylindrical outer housing 47 of insulating resin, a cylindrical inner housing 49 is provided, in such a manner that the latter 49 is integrally coupled to the outer housing 47 through coupling portions 51 (see FIG. 3), and a shell inserting groove 55 is formed between the outer housing 47 and the inner housing 49 into which a metal shell 53 is inserted. The inner housing 49 has a terminal accommodating chamber 59 which is adapted to accommodate a male terminal 57, and has elastic locking pieces 61 which are locked to the male terminal 57.

On the other hand, the shielded wire 63 is made up of: an insulated core 67 including conductors 65; a shielding braid 69 covering the insulated core 67; and an outer cover 71 covering the shielding braid 69. The outer cover 71 is partly removed from the shielded wire 63, to expose the shielding braid 69. The shielding braid 69 is folded over the insulated core 67, and then folded over the outer cover 71. That is, shielding braid 69 is folded over the insulated core 67 and the outer cover 71, thus forming steps.

An annular contact member 73 made of electrically conductive material is fitted on the part of the shielding braid which has been folded in the above-described manner. The contact member 73 is shaped as shown in FIG. 4. That is, it has a outer cylindrical surface, and a small-diameter inner cylindrical surface and a large-diameter inner cylindrical surface; that is, the contact member 73 includes a small-diameter portion **73*a* having the small-diameter inner cylindrical surface, and a large-diameter portion 73*b* having the large-diameter inner-cylindrical surface. The diameter of the small-diameter portion 73*a* is slightly smaller than the outside diameter of the part of the shielding braid 69 which has been folded over the insulated core 67, and the diameter of the large-diameter portion 73*b* is slightly smaller than the outside diameter of the part of the shielding braid 69 which has been folded over the outer cover 71. The small-diameter portion 73*a* and the large-diameter portion 73*b* have thread grooves 75** cut in their inner cylindrical surfaces.

When the contact member 73 thus shaped is fitted on the end portion of the shielded wire 63 with the large-diameter portion 73*b* set closer to the end portion of the shielded wire than the small-diameter portion 73*a*, the large-diameter portion 73*b* is fitted on the part of the shielding braid 69 which has been folded over the outer cover 71, while the small-diameter portion 73*a* is fitted on the part of the shielding braid 69 which has been folded over the insulated core 67. As was described above, the thread grooves 75 have been cut in the large-diameter and small-diameter inner cylindrical surfaces of the contact member 73. Hence, the thread grooves 75 are caused to bite the shielding braid, so that the contact member 73 is positively fixedly fitted on the shielding braid 69.

After the contact member 73 has been mounted on the shielded wire 63 in the above-described manner, an annular inner rubber plug 77 is mounted on the insulated core 67 on the end portion of the shielded wire. In this operation, the rubber plug 77 is fixedly mounted on the insulated core 67, because the inside diameter of the rubber plug 77 is slightly smaller than the outside diameter of the insulated core 67. Furthermore, the inner rubber plug 77 is fitted in a rubber-plug fitting section 79 formed in the rear end portion of the inner housing 49. The inside diameter of the rubber-plug fitting section 79 is smaller than the outside diameter of the inner rubber plug 77. Hence, the gap between the insulated core 67 at the rear end portion of the inner housing 49, and the inner cylindrical surface of the inner housing 49 is closed water-tight.

The above-described male connector 43 is assembled as follows: First, an outer rubber plug 81 is mounted on the outer cover 71 of the shielded wire 63. Next, the outer cover 71 is partially removed from the wire to expose the shielding braid 69. The shielding braid 69 thus exposed is folded while forming steps. Thereafter, the contact member 73 is mounted on the part of the shielding braid which has been folded in the above-described manner. Under this condition, the inner rubber plug 77 is mounted on the insulated core 67, and then the wire connecting section 57*a* of the male terminal 57 is press-fitted on the conductors 65 of the insulated core 67.

Under this condition, the male terminal 57, to which the shielded wire 63 has been connected, is inserted into a terminal accommodating chamber 59 of the inner housing 49 from behind. When the male terminal 57 thus inserted reaches a predetermined position, the elastic locking pieces 61 fixedly secure the male terminal 57, so that the latter is prevented from coming off the terminal accommodating chamber 59.

At the same time, the inner rubber plug 77 is fitted in the rubber plug fitting section 79 formed in the rear end portion of the inner housing 49, while the contact member 73 is brought into contact with the inner cylindrical surface of the rear part of the metal shell 53, and the outer rubber plug 81 is fitted in the rear end portion of the outer housing 47. After the outer rubber plug 81 has been fitted in the rear end portion of the outer housing 47 as was described above, a rear holder 83 is mounted on the rear end portion of the outer housing 47, to prevent the outer rubber plug 81 from coming off the housing. Thus, the male connector 43 has been assembled.

In the male connector 43 thus assembled, as shown in FIG. 3, the end portion of the inner housing 49 is arranged around the male terminal 57 in such a manner that the end portion and the male terminal 57 are coaxial with each other, while the end portion of the outer housing 47 is arranged around the end portion of the inner housing 49 in such a manner that those end portions are coaxial with each other.

Incidentally, the female connector 45 is substantially equal in structure to the male connector 43. That is, the outer housing 91, metal shell 93, inner housing 95 and female terminal 97 of the female connector 45 are different in structure from those of the male connector 43; however, the shielded wire 63, inner rubber plug 77, contact member 73, outer rubber plug 81, and rear holder 83 of the female connector are equal in structure to those of the male connector.

Hence, only the components of the female connector which are different from those of the male connector will be described. The outer housing 91 is cylindrical, and is made of insulating resin. The inner housing 95 is also cylindrical, and is provided inside the outer housing 91 in such a manner that the former is integral with the latter, and a shell inserting groove 101 is formed between the outer housing 91 and the inner housing 95 into which the metal shell 93 is inserted. The inner housing 95 has a terminal accommodating chamber 103 which is adapted to accommodate the female terminal 97. The chamber 103 has elastic locking pieces 105 which are adapted to fixedly secure the female terminal 97.

In the engaging portion of the female connector 45, as shown in FIG. 6, the outer housing 91 is arranged around the inner housing 95 in such a manner that those housings are coaxial with each other, and an outer cylinder 107 is arranged around the end portion of the housing 91 in such a manner that the former 107 is coaxial with the latter 91. Hence, as shown in FIG. 5, a first annular gap 109 is formed between the inner housing 95 and the outer housing 91, and a second annular gap 111 is formed between the outer housing 91 and the outer cylinder 107. An inner packing 113 is mounted on the inner housing 95, and an outer packing 115 is mounted on the outer housing 91.

Similarly as in the case of the above-described male connector 43, the inner rubber plug 77, the contact member 73 and the outer rubber plug 81 are coupled to the shielded wire 63, and the latter 63 is connected to the female terminal 97. When the female terminal 97 connected to the shielded wire is inserted into the inner housing 95 from behind, the elastic locking pieces 105 fixedly support the female terminal 97, so that the latter 97 is prevented from coming off the terminal accommodating chamber 103.

The functions of the various components of the connector assembly 41 formed by engaging the male connector with the female connector will be described.

When the male connector 43 is engaged with the female connector 45 as shown in FIG. 1, the end portion 49*a* of the inner housing 49 of the male connector 43 is inserted into the first annular gap 109 of the female connector 45, while the end portion 47*a* of the outer housing 47 of the male connector 43 is inserted into the second annular gap 111 of the female connector.

The inner cylindrical surface of the end portion 49*a* of the inner housing of the male connector 43, which is inserted into the first annular gap 109 of the female connector 45, is brought into close contact with the inner packing 113. That is, the inner housings 49 and 95 of the male connector 43 and the female connector 45 are engaged water-tight with each other. On the other hand, the inner cylindrical surface of the end portion 47*a* of the outer housing of the male connector 43, which is inserted into the second annular gap 111, is brought into close contact with the outer packing 115. Hence, the outer housings 47 and 91 of the male connector 43 and the female connector 45 are engaged water-tight with each other.

The gap between the rear end portion of the inner housing 49 and the insulated core 67 is sealed water-tight with the inner rubber plug 77, and similarly the gap between the rear end portion of the inner housing 95 and the insulated core 67 is closed water-tight with the inner rubber plug 77. Accordingly, the inside of the connector assembly 41 is divided into the spaces inside the inner housings 49 and 95, and the outer housings 47 and 91; that is, the connector assembly 41 is sealed double. Thus, the metal shells 53 and 93 inserted between the outer housings 47 and 91 and the inner housing 49 and 95 are insulated from the terminals 57 and 97 accommodated in the inner housings 49 and 95, respectively. Hence, even when dew-drops are formed in one of the spaces, the difficulty is eliminated that the dew-drops flow in both of the spaces, thus resulting in the occurrence of electric leakage between the metal shells 53 and 93 and the male and female terminals 57 and 97.

Figure 7:
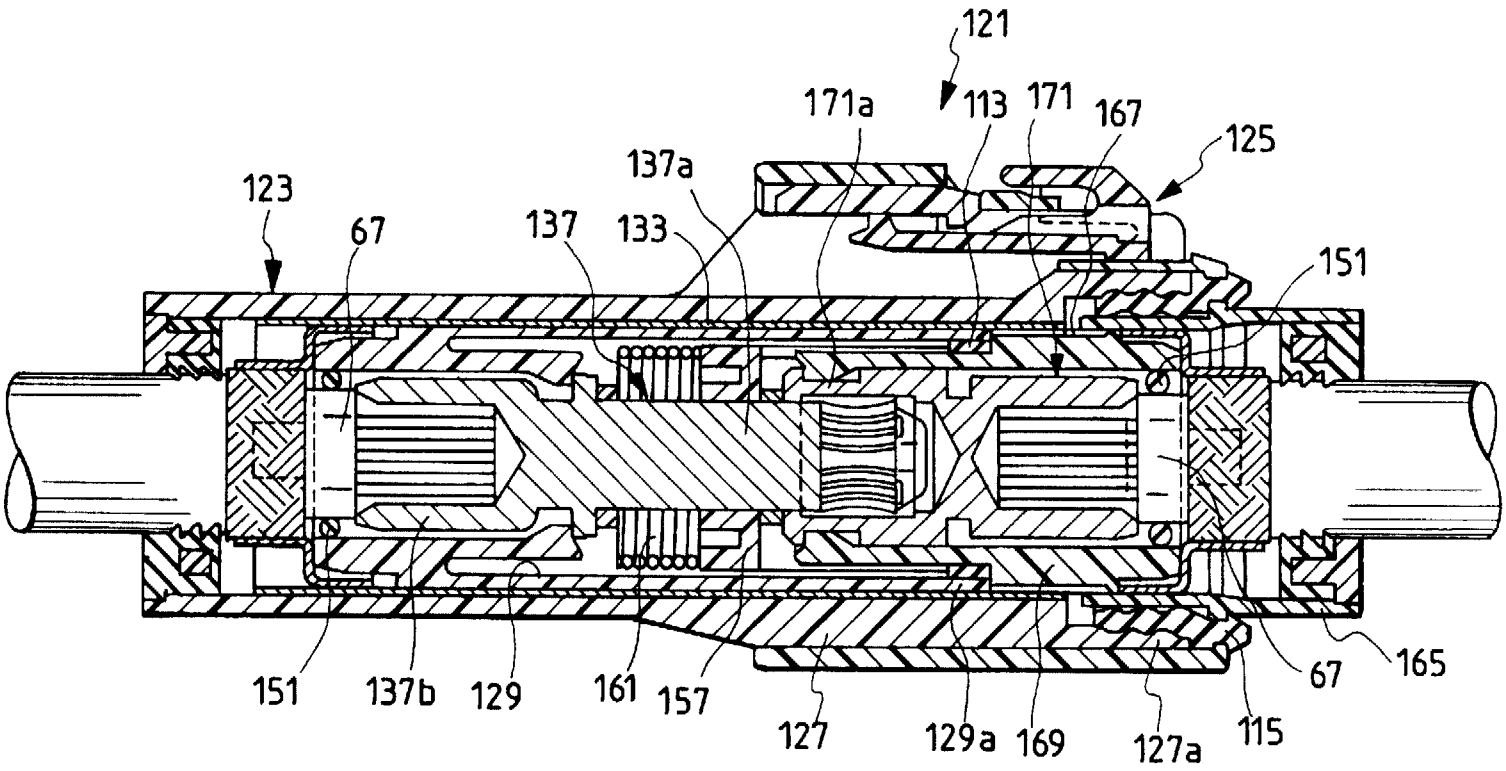
FIG. 7 is a sectional view showing another example of the dewing-trouble-prevented water-proof connector assembly, which shows a second embodiment of the invention.
Figure 8:
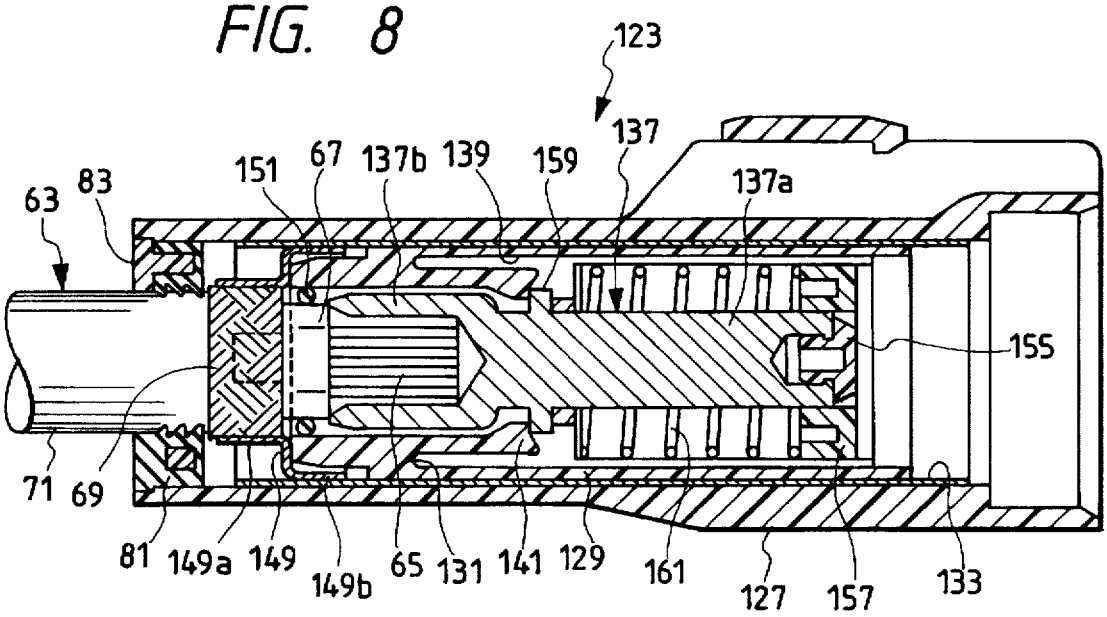
FIGS. 8 and 9 are a sectional view and a front view of a male connector forming the connector assembly shown in FIG. 7, respectively.
Figure 9:
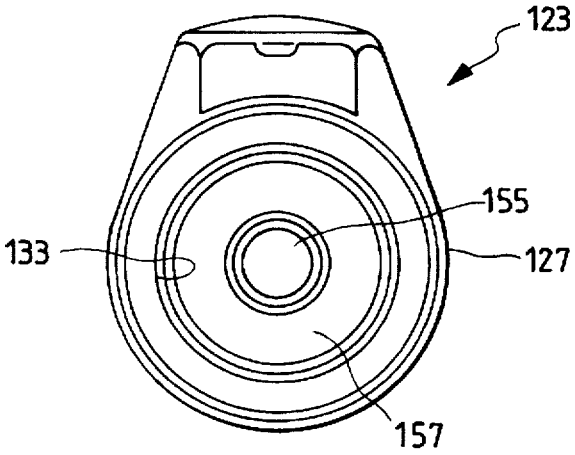
Figure 10:
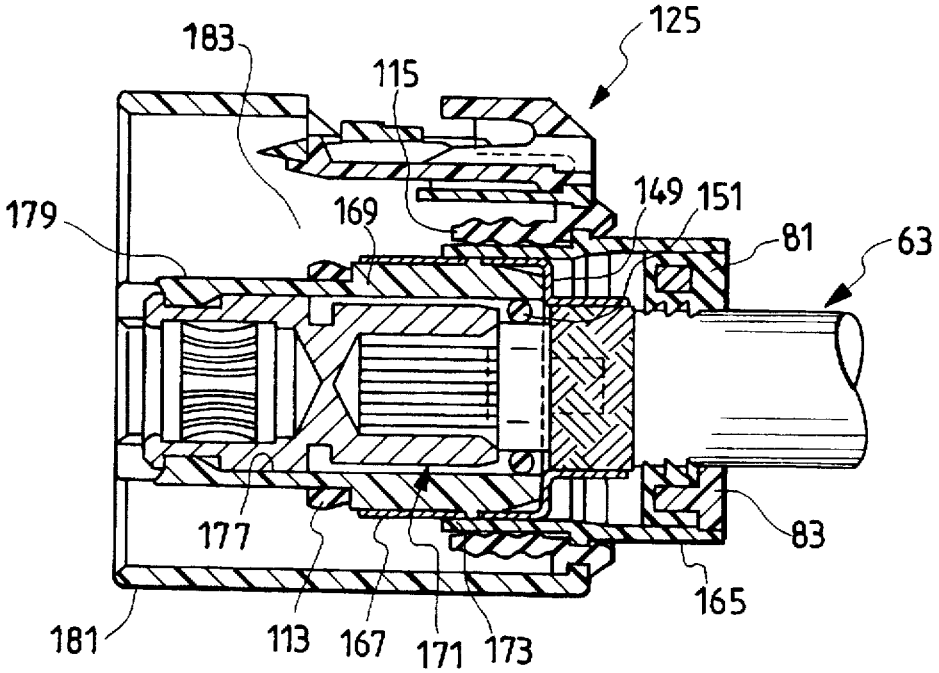
FIGS. 10 and 11 are a sectional view and a front view of a female connector forming the connector assembly shown in FIG. 7, respectively.
Figure 11:
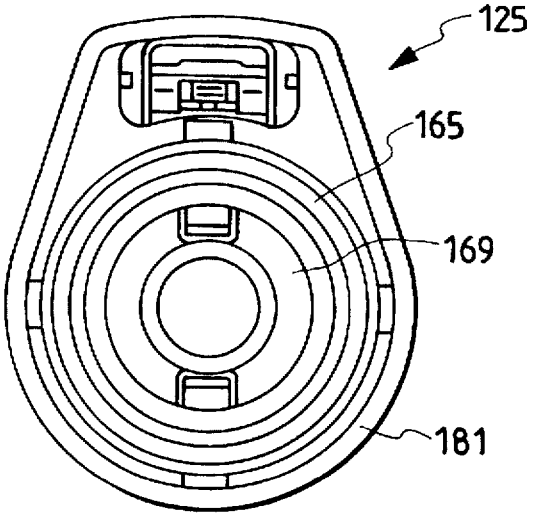
Figure 12:
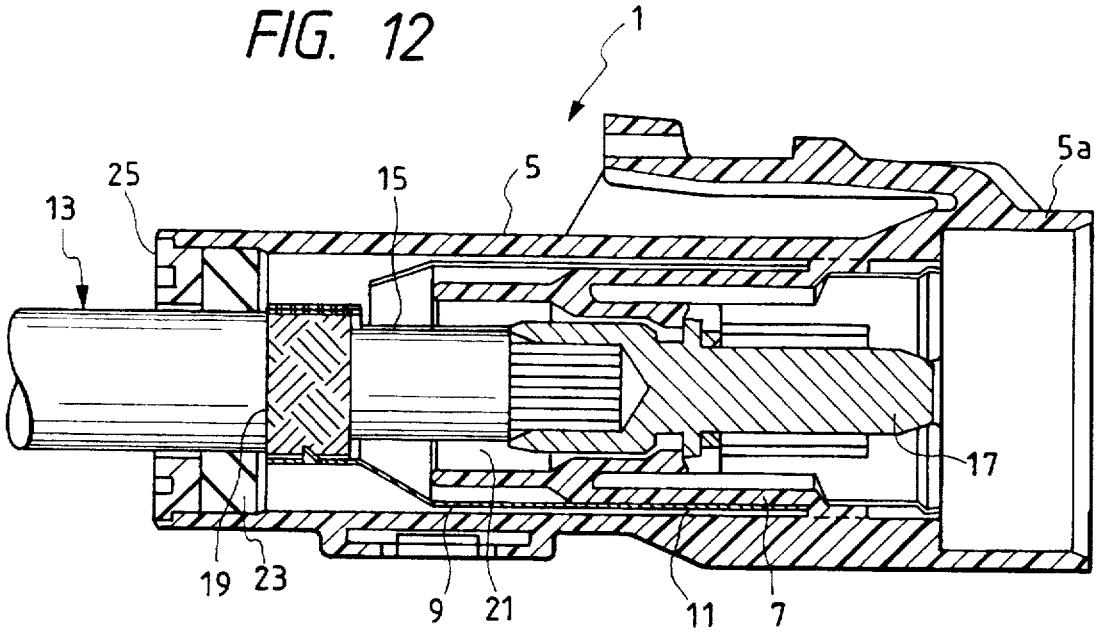
FIG. 12 is a sectional view of a conventional male connector.
Figure 13:
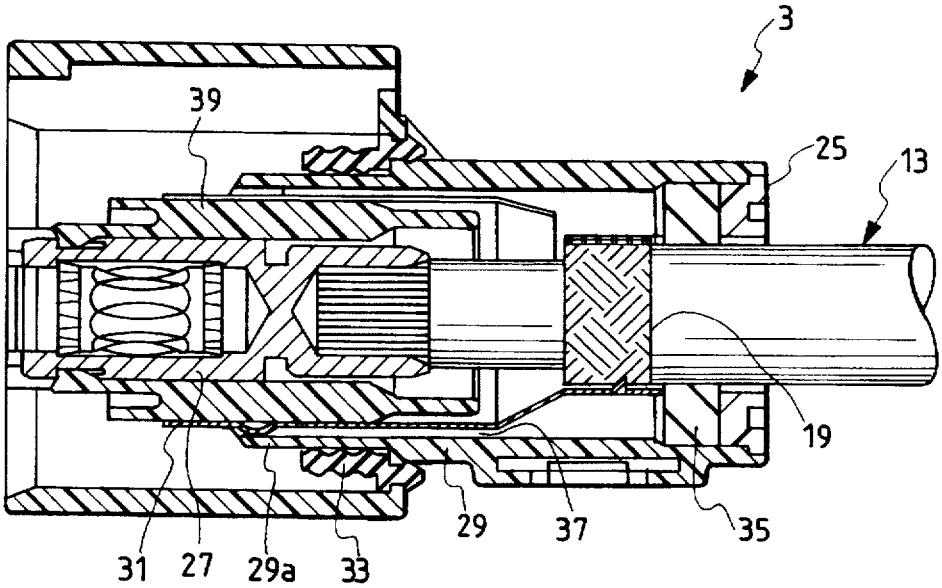
FIG. 13 is a sectional view of a conventional female connector.
Figure 14:
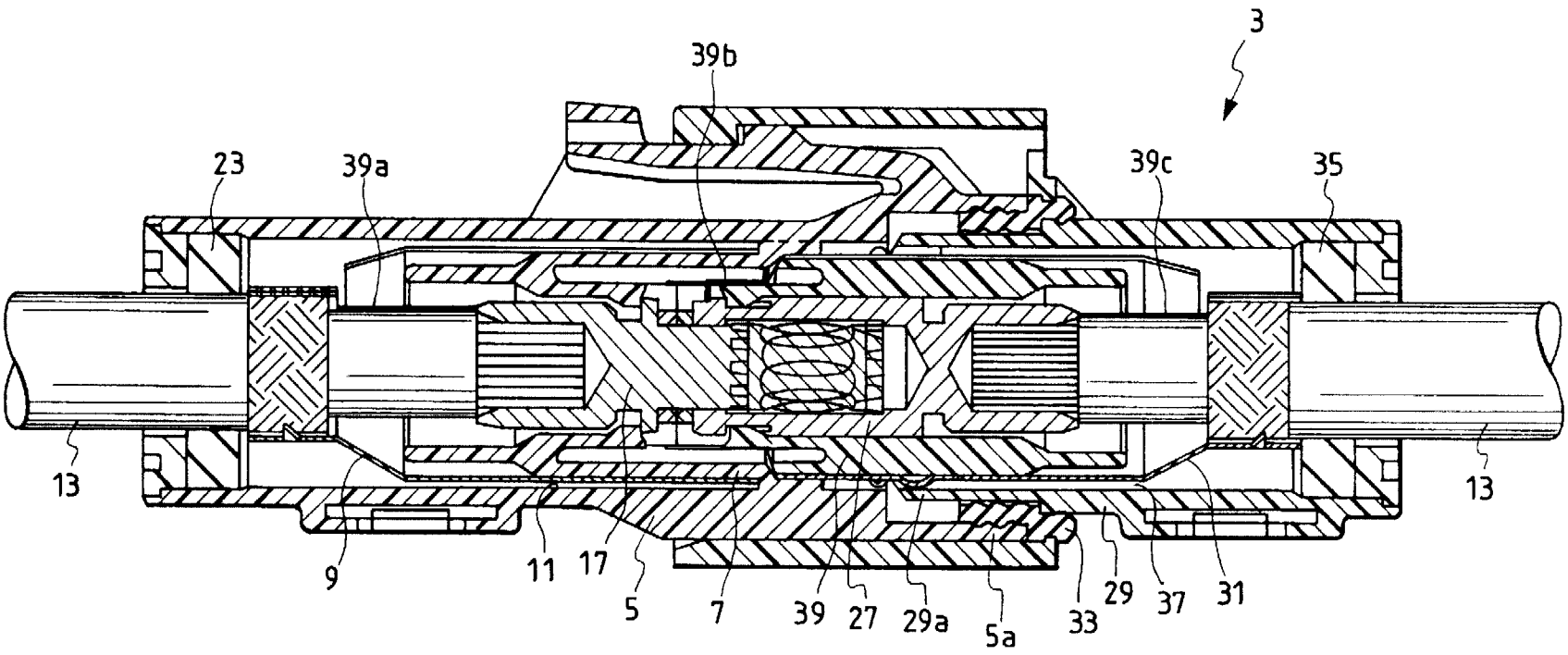
FIG. 14 is a conventional connector assembly which is formed by engaging the conventional connectors shown in FIG. 12 and 13.

Now, another example of the dewing-trouble-prevented water-proof connector assembly, which shows a second embodiment of the invention will be described with reference to FIGS. 7 through 11. FIG. 7 is a sectional view of the connector assembly. FIGS. 8 and 9 are a sectional view and a front view, respectively, showing a male connector forming the connector assembly shown in FIG. 7. FIGS. 10 and 11 are a sectional view and a front view, respectively, showing a female connector forming the connector assembly shown in FIG. 7.

The connector assembly 121, the second embodiment, includes the male connector 123 and female connector 125 which are engageable with each other.

First, the male connector 123 will be described. As shown in FIG. 8, inside a cylindrical outer housing 127 of insulating resin, a cylindrical inner housing 129 is provided in such a manner that the former 127 is coupled through coupling portions 131 to the latter 129 as one unit. A metal shell 133 is inserted into the space between the outer housing 127 and the inner housing 129. The inner housing 129 has a terminal accommodating chamber 139 which is adapted to accommodate a male terminal 137. The terminal accommodating chamber 139 has elastic locking pieces 141 which are adapted to fixedly support the male terminal.

On the other hand, an outer cover 71 is partially removed from the shielded wire 63 provided for the male connector, to expose the shielding braid 69. The shielding braid 69 thus exposed is folded over the outer cover 71. A contact element 149 of electrically conductive material is press-fitted on the shielding braid thus folded. The contact element 149 includes a small diameter portion **149*a* which is press-fitted on the shielding braid 69, and a large-diameter portion 149*b* which is engaged with the inner surface of the rear end portion of the metal shell 133**.

In the end portion of the shielded wire 63 on which the contact element 149 is mounted in the above-described manner, an O-ring 151 is mounted on the insulated core 67. The inside diameter of the O-ring 151 is slightly smaller than the outside diameter of the insulated core 67, so that the O-ring 151 is brought into close contact with the outer cylindrical surface of the insulated core 67. In addition, the outside diameter of the O-ring 151 is slightly larger than the inside diameter of the inner housing 129. Hence, the gap between the insulated core 67 at the rear of the inner housing 129 and the inner cylindrical surface of the inner housing 129 is closed water-tight by the O-ring 151 mounted on the insulated core 67.

In the above-described second embodiment, an insulating cap 155 is put on the end of the electrical contact portion **137*a* of the male terminal 137. A moving plate 157 is slidably mounted on the outer cylindrical surface of the electric contact portion 137*a*; however, it should be noted that a stopper (not shown) is provided to prevent the moving plate 157 from coming off the end of the electric contact portion 137*a*. The male terminal 137 has a flange 159 at the middle, and a spring 161 is interposed between the flange 159 and the moving plate 157. The spring 161 urges the moving plate 157 to be at the end of the electric contact portion 137*a*. That is, normally the moving plate 157 is at the end of the electric contact portion 137*a*, while the electric contact portion 137*a* of the male terminal 137** is not protruded from the front surface of the connector.

The above-described male connector is assembled as follows:

First, the outer rubber plug 81 is mounted on the outer cover 71 of the shielded wire 63. Next, the outer cover 71 is partially removed from the end portion of the shielded wire to expose the shielding braid 69. The shielding braid 69 thus exposed is folded over the shielded core. Thereafter, the contact element 149 is mounted on the part of the shielding braid 69 thus folded. Next, an O-ring 151 is mounted on the insulated core 67, and the electric contact portion **137*b* of the male terminal 137 is press-fitted on the conductors 65 of the insulated core 67**.

Thereafter, the male terminal 137 to which the shielded wire 63 has been connected is inserted into the terminal accommodating chamber 139 of the inner housing from behind. When the terminal 137 reaches a predetermined position in the terminal accommodating chamber 139, the elastic locking pieces 141 fixedly support the male terminal 137, so that the latter 137 is prevented from coming off the terminal accommodating chamber 139.

At the same time, the O-ring 151 is fitted in the rear end portion of the inner-housing 129, and the contact element 149 is brought into contact with the inner cylindrical surface of the rear end portion of the metal shell 133, and the outer rubber plug 81 is fitted in the rear end portion of the outer housing 127. In addition, a rear holder 83 is mounted to prevent the outer rubber plug 81 from coming off the outer housing 127. Thus, the male connector 123 has been assembled.

On the other hand, the female connector 125, unlike the male connector, has none of the insulating cap 155, moving plate 157, and spring 161. That is, as is seen from FIG. 10, the female connector is different from the male connector 123 in the arrangement of an outer housing 165, metal shell 167, inner housing 169 and female terminal 171; however, the female connector is equal to the male connector in the use of a shielded wire 63, O-ring 151, contact element 149, outer rubber plug 81, and rear holder 83.

Hence, mainly the parts of the female connector which are different from those of the male connector will be described. Inside the cylindrical outer housing 165 of insulating resin, the inner housing 169 which is also cylindrical is provided in such a manner that the latter 169 is coupled through coupling member 173 to the former 165 as one unit. The metal shell 167 is inserted between the outer housing 165 and the inner housing 169. The inner housing 169 has a terminal accommodating chamber 177 which is adapted to accommodate the female terminal 171. The terminal accommodating chamber 177 has elastic locking pieces 179 which are locked to the female terminal 171.

In the engaging surface of the female connector 125, as shown in FIG. 11, the outer housing 165 is arranged around the inner housing 169 in such a manner that the former 165 is coaxial with the latter 169, while an outer cylinder 181 is arranged around the front end portion of the outer housing 165 in such a manner that the former 181 is also coaxial with the latter. Hence, as shown in FIG. 10, a stepped inserting gap 183 is formed between the inner housing 169 and the outer cylinder 181. An inner packing 113 is fitted on the outer cylindrical surface of the inner housing 169, and an outer packing is fitted on the outer cylindrical surface of the outer housing 165.

The female connector 125 is assembled as follows: Similarly as in the case of the male connector 123, the shielded wire 63, to which the O-ring 151, the contact element 149 and the outer rubber plug 81 have been coupled, is connected to the female terminal 171. The female terminal 171, to which the shielded wire has been connected, is inserted into the terminal accommodating chamber 177 of the inner housing 169 from behind. In this operation, the elastic locking pieces 179 are allowed to fixedly support the female terminal 171, so that the latter 171 is prevented from coming off the terminal accommodating chamber 177.

As the same time, the O-ring 151 is fitted in the rear end portion of the inner housing 169, and the contact element 149 is brought into contact with the inner cylindrical surface of the rear end portion of the metal shell 167. In addition, the outer rubber plug 81 is fitted in the rear end portion of the outer housing 165. A rear holder 83 is fitted in the rear end portion outer housing 165 in which the outer rubber plug 81 has been fitted, so that the outer rubber plug 81 is prevented from coming off the outer housing. Thus, the female connector 125 has been assembled.

The functions of the various components of the connector assembly 121 formed by engaging the male connector 123 with the female connector 125 will be described.

As shown in FIG. 7, when the male connector 123 is engaged with the female connector 125, the moving plate 157 is moved against the elastic force of the spring 161, the electric contact portion 137*a* of the male terminal 137 is inserted into the electric contact portion 171*a* of the female terminal 171. At the same time, the front end portion 129*a* of the inner housing 129 of the male connector 123, and the front end portion 127*a* of the outer housing 127 of the male connector 123 are inserted into the inserting gap 183 of the female connector 125.

The inner cylindrical surface of the front end portion 129*a* of the inner housing of the male connector 123 which has been inserted into the inserting gap 183 of the female connector 125 is brought into close contact with the inner packing 113. That is, the inner housings 129 and 169 of the male connector 123 and the female connector 125 are engaged water-tight with each other. The inner cylindrical surface of the front end portion 127*a* of the outer housing of the male connector 123 is brought into close contact with the outer packing 115. That is, the outer housings 127 and 165 of the male connector 123 and the female connector 125 are engaged water-tight with each other.

The gaps between the rear ends of the inner housings 129 and 169 and the respective insulated cores 67 are closed water-tight by the O-rings 151, respectively. Accordingly, the inside of the connector assembly 121 is divided into the spaces inside the inner housings 129 and 169 and the outer housing 127 and 165; that is, the connector assembly 121 is sealed double. Thus, the metal shells 133 and 167 inserted between the outer housings 127 and 165 and the inner housings 129 and 169 are insulated from the terminals 137 and 171 accommodated in the inner housings 129 and 169, respectively. Hence, even when dew-drops are formed in one of the spaces, the difficulty is eliminated that the dew-drops flow in both of the spaces, thus resulting in the occurrence of electric leakage between the metal shells 133 and 167 and the male and female terminals 137 and 171.

As was described above in detail, in the dewing-trouble-prevented water-proof connector assembly of the invention, the inner packing and the outer packing are provided in the connector-engaging-plane, while the inner rubber plugs and the outer rubber plugs are mounted on the shielded wires. Hence, upon engagement of the male connector with the female connector, the inner housings of the male connector and the female connector are engaged water-tight with each other while the outer housings of those connectors are engaged water-tight with each other, and the inside of the connector assembly is divided into the spaces inside the inner housings and the outer housing; that is, the connector assembly is sealed double. Thus, the metal shells inserted between the outer housings and the inner housings are insulated from the terminals accommodated in the inner housings, respectively. Hence, even when dew-drops are formed in one of the spaces, the difficulty is positively eliminated that the dew-drops flow in both of the spaces, thus resulting in the occurrence of electric leakage. That is, the connector assembly of the invention is considerably high the reliability in safety.

What is claimed is:

1. A water-proof connector assembly, comprising:

a first connector comprising:

a first outer housing; and a first inner housing formed within said first outer housing, said first inner housing including a terminal accommodating chamber for accommodating a first terminal connected to a first shielded wire;

a second connector comprising:

a second outer housing;

a second inner housing formed within said second outer housing, said second inner housing including a terminal accommodating chamber for accommodating a second terminal connected to a second shielded wire;

an inner packing mounted on an outer surface of said second inner housing; and an outer packing mounted on an outer surface of said second outer housing, wherein when said first connector is engaged with said second connector, a front end portion of said first inner housing is engaged with a front end portion of said second inner housing to set said inner packing in close contact with an inner surface of the front end portion of said first inner housing, and a front end portion of said first outer housing is engaged with a front end portion of said second outer housing to set said outer packing in close contact with the inner surface of said first outer housing.

2. The water-proof connector assembly of claim 1, further comprising:

a first metal shell provided between said first outer housing and said first inner housing;

a first contact member fitted on a part of a shielding braid of the first shielded wire, said first contact member being contacted with said first metal shell;

a second metal shell provided between said second outer housing and said second inner housing; and a second contact member fitted on a part of a shielding braid of the second shielded wire, said second contact member being contacted with said second metal shell, wherein when said first connector is engaged with said second connector, said first metal shell and said second metal shell are connected to each other.

3. The water-proof connector assembly of claim 2, wherein each of said first and second contact members includes a respective outer cylindrical surface and a respective inner surface, said inner surface comprising a small-diameter portion and a large-diameter portion, said small-diameter portion having a small-diameter inner cylindrical surface and said large-diameter portion having a large-diameter inner cylindrical surface, wherein the small-diameter portion and the large-diameter portion each have threaded grooves cut in their inner cylindrical surfaces.

4. The water-proof connector assembly of claim 1, further comprising inner rubber plugs mounted on insulated cores of the first and second shielded wires, respectively, wherein said inner rubber plugs close gaps water-tight which are formed respectively between insulated cores of said first and second shielded wires and said first and second inner housings.

5. The water-proof connector assembly of claim 1, further comprising outer rubber plugs mounted on outer covers of the first and second shielded wires, respectively, said outer rubber plugs close the gaps water-tight which are formed respectively between said first and second outer housings and the outer covers of said first and second shielded wires.

* * * * *